United States Patent [19]

Toshio

[11] 4,169,688

[45] Oct. 2, 1979

[54] ARTIFICIAL SKATING-RINK FLOOR

[76] Inventor: Sato Toshio, Shigasato 3-22-14, Otsu-shi, Shiga-ken, Japan

[21] Appl. No.: 849,942

[22] Filed: Nov. 9, 1977

Related U.S. Application Data

[63] Continuation of Ser. No. 666,974, Mar. 15, 1976, abandoned.

[51] Int. Cl.[2] ..... E01C 5/20

[52] U.S. Cl. ..... 404/40; 52/586

[58] Field of Search ..... 273/1 B; 52/585, 586, 52/177, 541; 404/17, 35, 40

[56] References Cited

U.S. PATENT DOCUMENTS

| | | | |
|---|---|---|---|
| 2,127,199 | 8/1938 | Austhoff | 52/541 |
| 2,138,085 | 11/1938 | Birtles | 52/584 |
| 2,244,343 | 6/1941 | Meyercord | 52/585 |
| 2,595,111 | 4/1952 | Steward | 52/585 |
| 3,350,092 | 10/1967 | Isao Maki | 52/592 |
| 3,508,945 | 4/1970 | Haemer | 273/1 B |
| 3,771,891 | 11/1973 | Nirewski | 404/40 |

FOREIGN PATENT DOCUMENTS

| | | | |
|---|---|---|---|
| 1322100 | 2/1963 | France | 52/586 |
| 1053636 | 1/1967 | United Kingdom | 52/177 |

*Primary Examiner*—John E. Murtagh

*Attorney, Agent, or Firm*—Allegretti, Newitt, Witcoff & McAndrews

[57] ABSTRACT

An artificial ice skating rink floor with a layer of cushion material thereon and a plurality of floor plates formed of ultra-high molecular weight polyethyene laid directly on the layer of cushion material with the floor plates held in position by plate-like and U-shaped insertion members.

1 Claim, 13 Drawing Figures

ARTIFICIAL SKATING-RINK FLOOR

This is a continuation of application Ser. No. 666,974, filed Mar. 15, 1976, now abandoned.

DETAILED EXPLANATION OF THE INVENTION

In the past, skating rinks utilized, for the most part, natural freezing of water or artificial ice. In case of natural skating rinks, however, the availability thereof is depended greatly, as a natural matter of course, on weather or meteorology, thus allowing the use thereof for only a very limited period of the season. In addition, these rinks are usually located very far from the centers of large cities, thus making it all the harder for most skaters to have chances to enjoy easy skating regardless of time. On the other hand, artifically frozen rinks require huge costs of equipment and as big costs for power consumed for freezing. Thus, in case of year-round operation, not to mention the case of winter operation, such rinks were naturally apt to charge high for skating. Such being the case, in spite of the fact that the number of skaters is increasing year by year and the fact that skating is a sport suitable for strengthening of our bodies, particularly the legs and waists, it has not been practically possible to have chances to enjoy skating easily regardless of time and place.

In the light of the above, three types of artificial skating-rink floors composed of, say, various synthetic resins came to be developed in the past for the purpose of allowing year-round skating without requiring any power for freezing; and further efforts were made to improve them sufficiently to be put to practical use. However, all such attempts ended in failure because all of said artificial skating-rink floors were insufficient or defective in lubricating property; they could give only a skating feeling far from, or far less pleasant than, that in case of ice skating, and in addition, they were subject to expansion and contraction due to temperature change, swell resulting from water-adsorption (of the material resins), etc., thus causing uneveness or irregularities and cracks in the floor surfaces whereby to produce an unskatable situation. Further, such skating-rink floors cause the skate edges to wear to a conspicuous degree. All these technical problems have been left unsolved.

Under such circumstances, the present invention is related to an artificial or synthetic skating-rink floor arranged so as to provide a lubricating property as well as a skating feeling equivalent to that in case of the conventional artifically frozen rinks, said rink floor being free from being affected by temperature change or water adsorption, thus ensuring that skate edges are not worn away and allowing easy assemblying, disassemblying, and transportion thereof.

Figure 1:
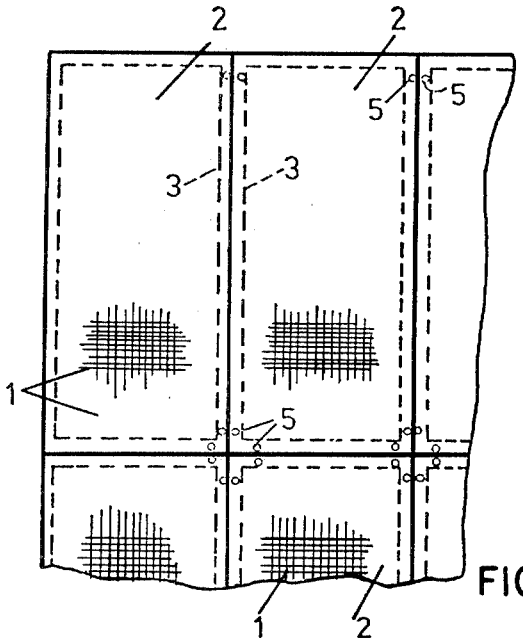
FIG. 1 is a plan view of a first embodiment of the present invention
Figure 2:
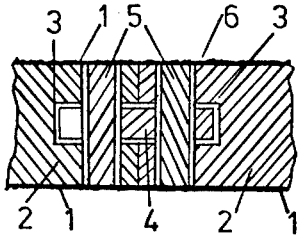
FIG. 2 is a sectional view of the joint portion.

Embodiments of the present invention will now be described in detail by referring to the drawings:

EMBODIMENT 1

A number of material plates 2 are prepared in such a manner that the upper surface or the upper and lower surfaces of each material plates 2 determined to a suitable size and composed of a polyolefin resin such as an ultra-high-molecular-weight polyethylene are, roughened as at 1 (to a net-pattern of, say, 20 meshes), and cut-away or recessed grooves 3 are provided along and in all the peripheral side-faces. Then, these material plates are successively laid down in alignment on the floor base of the respective skating rink in such a manner that the grooves 3,3 of the respective material plates are confronted with each other. Common insertion pieces 4 made of a metal, a synthetic resin or the like are fitted into the respective confronting grooves; thereafter, there are made bores 6 extending through both the material plates 2 and the insertion pieces 4 together; then, fixing pins 5 made of the same material as the plates 2 are put into said bores; the heads of the thus inserted pins are cut off to be level smoothly with the surface of the respective plates 2; and finally, the material plates are fastened with which the rink floor is completed.

Figure 3:
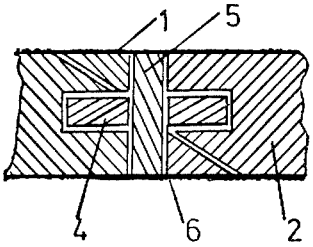
FIGS. 3 and 4 are partial sectional views showing the joint portions in alterations of the first embodiment.
Figure 4:
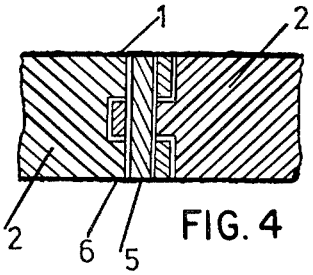
Figure 5:
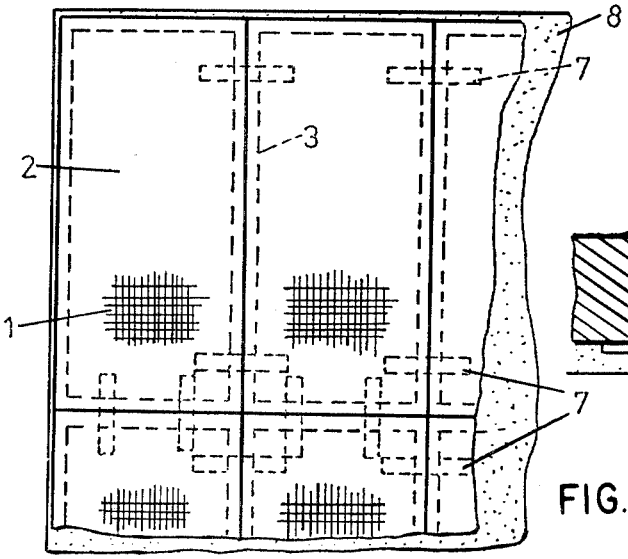
FIG. 5 is a plan view of a second embodiment of the present invention.
Figure 6:
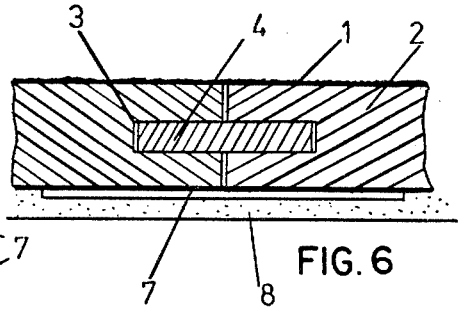
FIG. 6 is a sectional view of the joint portion of the second embodiment.

If, in cutting the outer peripheral edges of the material into plates 2,2 as per the predetermined dimensions, the material is cut not at a right angle with the surface thereof, but askantly, then the fixing operation for the plates 2,2 will be reduced to about half in time and labor, since, in that case, the joined portions of the plates are in overlapped relationship as shown in FIG. 3. Alternatively, it is also possible to arrange the joined portions of the plates 2,2 into a protrusion and a depression, mutually engageable, whereby the provision of no insertion pieces 4 is required as noticed from FIG. 4.

EMBODIMENT 2

Figure 8A:
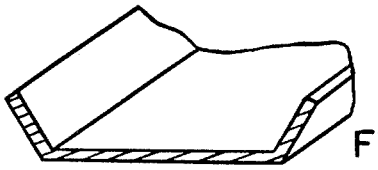
FIG. 8-A and -B are perspective views showing the joining members in alterations of the second embodiment.
Figure 7:
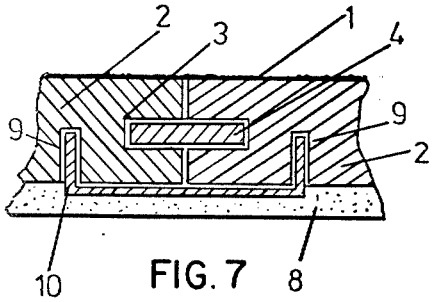
FIG. 7 is a sectional view showing the joint portion of the second embodiment.
Figure 8B:
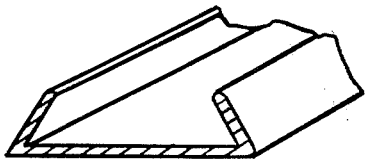

First, a cushion material 8, about 5 mm in thickness and having elastic cushioning characteristics, such as, e.g., a high-density foamed polyethylene body is laid extending all over the floor base of the prospective skating rink. Then, on the cushion material thus disposed, there are laid down in alignment a number of ultra-high-molecular-weight polyethylene plates 2, each dimmensioned suitably, e.g., one (1) meter in width, two (2) meters in length and 18 mm in thickness, with the upper surface or both the upper and lower surfaces roughened as at 1; cut-away or recessed grooves 3 are provided in the peripheral sides of said plates 2, said plates 2,2 being arranged in such a manner that the respective grooves 3,3 thereof are confronted with each other, in which case the plates 2,2 are fastened by applying an adhesive tape 7 onto the underside of each joint portion between the plates 2,2. Then, common plate-like insertion pieces 4 are inserted into the grooves 3,3 confronting each other along the joint of the plates 2,2; and thus, the same assembling operation is continuously or repeatedly carried out until a predetermined size of area is reached when a water-soluble lubricant is applied onto the surface of the plates, with which the rink floor is completed. If, in this case, the place where the rink is installed or established is subject to large temperature change or is to be relatively large in floor space, then it is preferable to use a glass-fiber-reinforced adhesive tape in place of a common adhesive tape in order for it to be able to stand the variation in stress of the floor plates. Further, as joining means, it is also permissible to use U-shaped insertion members 10 as shown in FIG. 7, in place of such adhesive tape, in which case notches or recesses 9 of suitable depth are provided, directed toward the upper surface, in the lower surface of the entire peripheral end portions of the surface-roughened plates 2, in which the U-shaped joining members 10, each having a relatively large strength, are inserted, thus forming a U-shape by connecting the recesses 9,9 located symmetrically with respect to the seam or joint line between the adjacent plates 2,2 and the bottom surfaces thereof. In this case, it is also allowed to arrange that the recesses 9,9 be not disposed at a right angle with the floor surface, but at any angle other than 90°; in other words, the upper portion of the U-shaped insertion member 10 may not be of the same dimmension as the lower portion, but wider or larger than the latter (FIG. 8-A) or narrower (FIG. 8-B). In any case, according to this joining method, the vertical displacement of the plates 2,2 can be prevented, and therefore, the plate-like insertion pieces 4 inserted into the peripheral cut-away grooves 3 may be omitted.

Figure 9A:
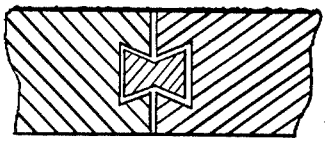
FIG. 9-A and -B are sectional views showing the joining members in alterations of the second embodiment.
Figure 9B:
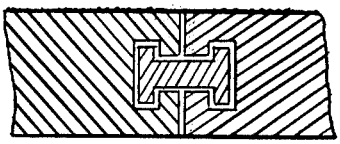

Further, if the peripheral grooves are made into a tapering shape (FIG. 9-A) or a T-shape (FIG. 9-B), so that there are inserted insertion pieces shaped to fit in with the inner shape formed when the plates are placed adjacent in alignment, the provision of said adhesive tape and said U-shaped joining members is not required.

In case of using such U-shaped joining members, it results in provision of projections extending downwardly of the plates by a portion corresponding to the thickness of said joining members; but, due to the cushion material provided between the floor base and the plates 2,2, the projecting portions of the joining members are allowed to sink into the cushion material as if they were absorbed or accommodated in the latter; thus, it does not affect at all the smoothness in surface of the rink floor (see FIG. 7).

Embodiment 2 described above is characterized in that the rink floor can be freely and easily assembled or installed as well as disassembled.

EMBODIMENT 3

Figure 10A:
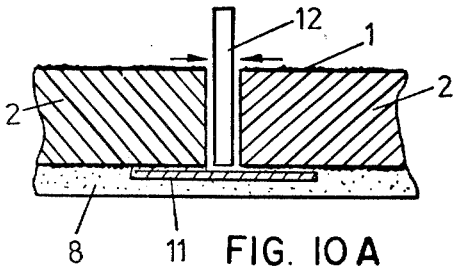
FIG. 10-A is a partial sectional view showing how the joint portion is bonded or fused in connection with a third embodiment, while FIG. 10-B is a partial sectional view showing the third embodiment with its joint-portion's bonding completed.
Figure 10B:
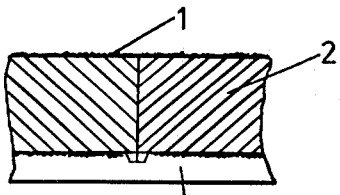

First, as described in connection with Embodiment 2, a elastic cushion material comprising, e.g., a highly-foamed high-density polyethylene or the like is laid down over the floor base of the prospective skating rink. On the cushion material thus disposed, a number of suitably sized plates composed of an olefin resin such as an-ultra-high-molecular-weight polyethylene are arranged in alignment in such a manner that the outer peripheral sides of the respective plates are placed adjacent to each other, the upper surface or the upper and lower surfaces of each said plate being roughened. The joining portions of the adjacent plates are heat-bonded or fused together by use of the heat from a plate heater 12 or the like as shown in FIG. 10-A. After fusion, the projections of the respective fused or heat-bonded surface portions are abraded or ground off by a portable sander grinder to make the surface smooth, thus completing the rink floor.

In the heat-bonding or fusing operation, a smooth, thermal insulating board 1 such as, e.g., asbestos is temporarily laid down under (the underside of) each bonded portion so as to prevent the formation of an indentation or stepwise mismatch in the joint portion between the plates 2,2 and at the same time to protect the underlying cushion material 8 from the heat applied in heat-bonding operation.

As the source of heat for heat-bonding, it is also preferable to use means arranged such that a metal wire or the like having an electric resistence is put into the joining portion and then electrified so as to effect fusion or heat-bonding by means of the heat produced by the wire.

Further, the fusion-resulting protrusions produced on the underside of the fused or heat-bonded portions of the material floor plates are accommodated or sink into the cushion material disposed thereunder, and therefore, they do not affect the smoothness in surface of the rink floor (See FIG. 10-B).

As is clear from the respective embodiments described above, the present invention is characterized in that a suitable number of suitably sized plates made of a polyolefin-series resin are arranged into a physically and chemically integral structure; that is, said plate are rendered into one sheet ranging over an area sufficient for formation of a rink floor. They are laid down on the floor base of the prospective rink floor directly or indirectly, if required—if the condition of the floor base or the installing operation requires—through a cushion material having a suitable cushioning characteristics.

Accordingly, the rink floor according to the present invention is free from the problems—which are defects of the conventional synthetic-resin rink-floors—such as the occurrance of local swells or irregularities and cracks in surface of the floor due to thermal expansion or contraction caused by temperature change and the swelling due to water absorption, since the whole floor, in case of the present invention, is arranged in the form of one sheet which is only subjected to a slight change in area of the rink floor in case of such temperature change or water absorption.

As the material for the rink floor, polyolefin-series resins are desirable in the light of lubricating characteristics; and, among them, polyethylene is relatively suitable, and, more strictly speaking, an ultra-high-molecular-weight polyethylene is the most preferable in consideration of the fact that the life and soul of skates lie in the slidability or lubricating property and the feeling in delicate skating performance brought about through the effect of the sharpness of their edges, and thus, the damage-proof property (of the floor) against such sharp edges should be considered important. As a result of our various tests, it has been found that the damage-proof property of the floor material for such sharp edges enhances with the increase in the average molecular weight thereof; in this connection, further, through the experiment of repeatedly pressing sharply ground blades under the same condition against two (2) kinds of polyethylene plates which both have the same thickness, but one of which has, for instance, an average molecular weight of 30,000, while the other has an average molecular weight of 1,040,000 (as measured viscometrically) to see the degree of damage (of the plates) by observing the weight ratio between the (polyethylene) powders flown off from the damaged portions thereof and by observation of the surface conditions (of the plates) by use of an enlarging projector, it has been found that the polyethylene plate having the average molecular weight of 1,040,000 does not show the same degree of damage as the one having the average molecular weight of 30,000 till the number of times of pressing the blade against the former reaches 28 times as many as in the case of the latter. In addition, polyolefin-series resins have the characteristics of wearing away no sharp blades unlike other kinds of synthetic resins. It has been found that preferentially ultra-high moleculare polyethylene with an average moleculare weight of 300,000 to 1,500,000 is suitable for the plates. In forming polyethylene plates, various lubricants or antistatic agents can be mixed in for improvement of the lubricating property thereof. The rink floor according to the present invention comprises an integral structure of rink-floor material which has a good lubricating property, as has been described, and can be effectively used for a relatively long period, and further, does not damage skate edges; and said floor material is disposed directly on the floor base or indirectly, if required, through an elastic cushion material. Therefore, the rink floor according to the invention is free from any trouble due to temperature change or water absorption. In case of providing the cushion material, the rink floor fits the floor base satisfactorily well, even if it (the floor base) is somewhat irregular or uneven in surface, due to the cushioning effect of the cushion material positioned under the rink-floor material, providing the effect that a skater can have a nice feeling while skating so as to minimize his weariness or fatigue particularly at his legs and waist, and further, when a number of skaters skate together, the noise due to the contact of their skate edges with the floor and the skating noise can be minimized, too. Besides, since the surface of the rink floor is roughened, the frictional or rubbing force caused between the skate edges and the surface tends to become smaller. Further, in case a lubricant in a liquid or finely powdered state (water-soluble oil, finely powdered talc, etc.) is used in order to improve the lubricating property, the irregularities of the roughened surface result in holding such lubricant relatively strongly and closely, thus providing a higher lubricating effect. In addition, the fine irregularities on the surface of the floor serve to make the skate edges to act effectively when the skater make a turn or kick while skating. In case the lower surface of the rink floor is roughened, the frictional force between the floor and the floor base or the cushion material underlying in contact therewith is reduced; and the contraction or expansion due to temperature change can be sensitively accommodated or absorbed by the rink floor as a whole. Besides, the rink floor according to the present invention, which does not dissolve like ice, can be arranged not only in a horizontal or plane state, but also in a suitable three-dimentional or inclined state.

In addition, the height of the irregularities of the roughness lies in the range of 0.1–1 mm, preferentially between 0.3–0.5 mm, while the width of the irregularities of the roughness lies within the range of 0.3–1 mm.

Further, since the rink floor can be easily assembled, disassembled and transported as in the case of Embodiment 2, it allows a skating rink to be fabricated or installed easily at very low expenses, regardless of when, where and whether it is indoors or outdoors. In addition, scarcely any expenses are required for the maintenance of the rink, thus allowing everybody to easily enjoy the sound and healthy skating sport, at low expenses.

Thus, the present invention can be easily and readily utilized at schools and work places for improvement of our bodies, particularly, the legs and waists, feared to be conspicuously weakened as compared with the people of old times, as well as for enhancement of the physical strength or health of pupils and students, and further, for practices or training of ice-hockey teams for instance, which was apt to be given up in the past because of high expenses.

I claim:

1. An artificial ice skating rink floor comprising, in combination:

a floor base;

a layer of cushion material laid directly on said floor base without adhesive;

a plurality of like floor plates each having a substantially flat upper surface, a lower surface and peripheral sides, said upper surface roughened in a net-like pattern of irregularities, said irregularities having a height within the range of 0.1 to 1.0 mm and a width within the range of 0.3 mm to 1.0 mm, each of said sides forming an elongated side recess, said lower surface forming elongated bottom recesses adjacent said sides, said floor plate being formed substantially of ultra-high molecular weight polyethylene having a viscometric average molecular weight of 300,000–1,500,000, said floor plates being laid directly on said layer of cushion material without adhesive and with said side recesses along adjacent sides of adjacent floor plates being substantially in alignment with one another so as to define aligned side recesses and with said bottom recesses along adjacent sides of adjacent floor plates being substantially parallel so as to define substantially parallel bottom recesses;

elongated, generally U-shaped insertion members having substantially upright legs; and elongated, plate-like insertion pieces;

said insertion pieces being inserted in said substantially aligned side recesses and said upright legs of said insertion members being inserted in said substantially parallel bottom recesses so that said floor plates are joined into one sheet-like structure capable of withstanding substantial temperature variation and water absorption substantially without local swells, irregularities and cracks in said ice skating rink floor.

* * * * *